United States Patent [19]

De Barsy

[11] 4,054,953

[45] Oct. 25, 1977

[54] CRASH HELMET

[76] Inventor: Philippe De Barsy, 6, dreve des Etangs, Bousval, Belgium

[21] Appl. No.: 718,474

[22] Filed: Aug. 30, 1976

[30] Foreign Application Priority Data

Sept. 2, 1975 Belgium ..... 832996

[51] Int. Cl.[2] ..... A42B 3/02

[52] U.S. Cl. ..... 2/414; 2/425

[58] Field of Search ..... 2/410–416, 2/421, 424, 425, 171.4–171.8

[56] References Cited

U.S. PATENT DOCUMENTS

| | | | |
|---|---|---|---|
| 3,223,086 | 12/1965 | Denton | 2/410 X |
| 3,315,272 | 4/1967 | Olt et al. | 2/424 |
| 3,496,854 | 2/1970 | Feldmann et al. | 2/410 X |
| 3,566,409 | 3/1971 | Hopper | 2/414 |
| 3,860,966 | 1/1975 | Brown et al. | 2/415 |
| 3,925,821 | 12/1975 | Lewicki | 2/425 |

FOREIGN PATENT DOCUMENTS

| | | | |
|---|---|---|---|
| 381,622 | 11/1907 | France | 2/171.4 |

*Primary Examiner*—Alfred R. Guest

*Attorney, Agent, or Firm*—Cushman, Darby & Cushman

[57] ABSTRACT

There is described a crash helmet which comprises at least one air inlet provided in that helmet area over which sweeps the air and so arranged as to canalize the air inside the helmet, means to distribute the air inside the helmet and at least one opening provided in the helmet wall in that area thereof over which the air does not sweep, to let the air escape from said helmet.

3 Claims, 8 Drawing Figures

CRASH HELMET

The invention relates to a crash helmet, particularly for drivers and passengers of motor vehicles such as motorcycles, motobikes, etc., which comprises a solid outer wall for covering the head, said wall being lined inside with means for cushioning impacts.

The crash helmets of the above-defined type which are used presently, have various drawbacks and notably they bring and retain the head top portion at an extreme heat, which causes on the one hand a strong sweating and a fast greasing-up of the hair and on the other hand, a large temperature differential between the various portions of the head which results in body reactions which are unpleasant for the user. Such helmets are thus uncomfortable, damage the hair and moverover by cold weather are a source of high chill risks when removing the helmet.

The invention has for an object to obviate said drawbacks and to provide a helmet with inner ventilating to retain therein a normal temperature, which first makes the helmet extremely comfortable, avoids any excessive skull sweating, hair greasing-up and said chill risks when removing the helmet. Said helmet has moreover the advantage of substantially no more messing-up the hair, which besides its comfort, makes the helmet use more bearable.

For this purpose according to the invention, the helmet comprises at least one air inlet provided in that helmet area over which sweeps the air and so arranged as to canalize the air inside the helmet, means to distribute the air inside the helmet and at least one opening provided in the helmet wall in that area thereof over which the air does not sweep, to let the air escape from said helmet.

In one embodiment of the invention, the air inlet and the means to distribute the air inside the helmet are so arranged as to direct the air and cause said air to flow from the head top to the head circumference.

In an advantageous embodiment of the invention, the helmet comprises means arranged inside the air inlet to filter said air and prevent water entering through said air inlet.

In a particularly advantageous embodiment, the helmet comprises means for cushioning impacts, which are comprised of a first layer of compressible material such as expanded polystyrene, which lines the helmet inner wall and a second material layer lining the first layer, which is present as open-cell foam, said means for distributing the air inside the helmet comprising a duct provided in the first material layer from the air inlet to the second material layer, the air flowing out from said duct being distributed inside the helmet through the open cells of said second material layer.

Other details and features of the invention will stand out from the drawings accompanying the present specification and which show by way of non-limitative examples, particular forms of embodiment of the helmet according to the invention.

In the various figures, the same reference numerals pertain to similar elements.

Figures 1, 2, 3, 4, 5, 6, 7, 8:
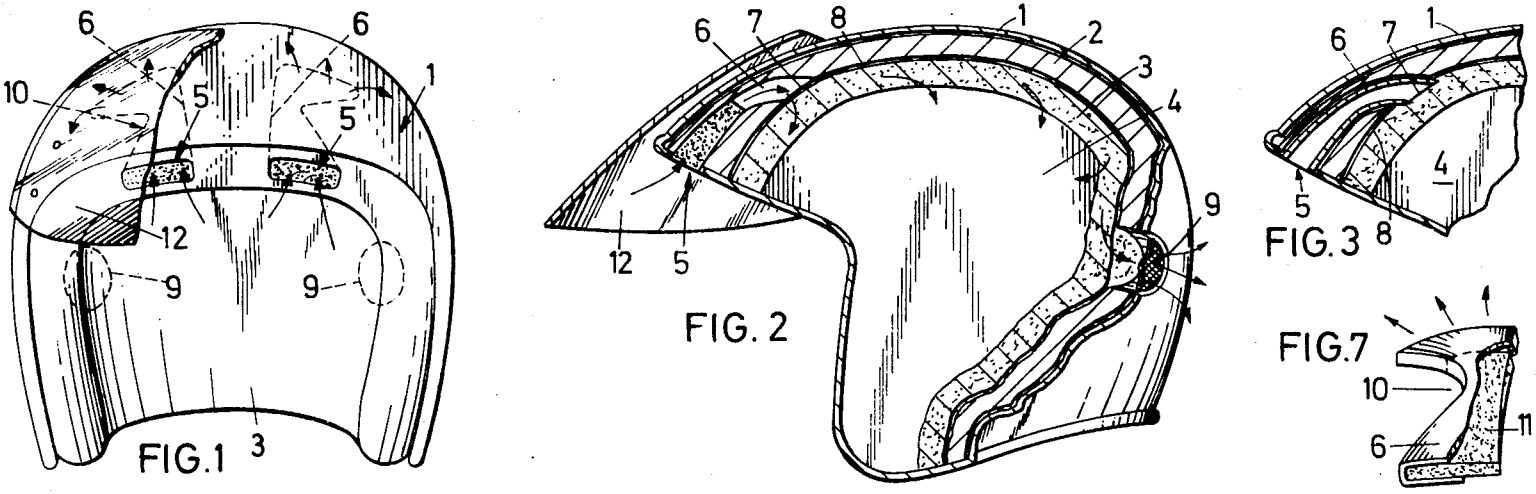
FIG. 1 is an elevation view with part broken away, of a helmet according to the invention.
FIG. 2 is a side view with part broken away, corresponding to the FIG. 1.
FIG. 3 is a part view similar to the FIG. 2, showing a modification of embodiment of the helmet according to the invention.
FIGS. 4, 5 and 6 are elevation views of the helmet according to the invention.
FIGS. 7 and 8 are views in perspective and with parts broken away, of details of the helmet according to the invention.

The crash helmet according to the invention as shown in FIGS. 1 and 2, comprises a solid outer wall 1 to cover the head, which is lined inwardly with a compressible material layer 2, such as expanded polystyrene that forms the helmet crown, which is covered in turn by a material layer 3 in the form of open-cell foam. The ventilating of the inner part 4 of the helmet is obtained through two front air inlets 5 provided in said material layer 2 and which communicate with ducts 6 provided in said material layer 2, said ducts ending in 7 on the front side 8 of material layer 3, said layer 3 insuring by means of the open cells thereof, the distributing of the air over all of the skull circumference, starting from the top portion of said skull which is most strongly ventilated, the discharge of air outside the helmet being made through two openings 9 which are located in that helmet portion where an underpressure is generated and at a level lower than the level of end 7 of ducts 6. Said ducts 6 are provided to enhance the air distribution, with a narrowed portion 10 which forms a Venturi section and each such duct is provided with a filter from a material in the form of open-cell foam. Said filter has for purpose to prevent the ingress of dust and water inside the helmet. It is advantageously possible to provide interchangeable filters with different densities which may be used according both to the ventilating desired by the helmet user and to the weather conditions. The helmet may also be provided with a movable visor 12 which can take two end positions, the one position in which the face is covered partly at least and another position where said face is free. The hinging of visor 12 and the profile thereof are advantageously so selected that when the visor lies in both said end positions or between said end positions, the air inlets 5 be located behind said visor and are thus protected thereby from dust and water projections. It would also be possible to provide a helmet fitted with a fixed visor which is so arranged that the air inlets 5 be located behind said visor to be protected from dust and water projections.

As shown in FIG. 3, it would be possible to provide ducts 6 molded separately from material layer 2, said ducts 6 being embedded in said material layer when molding same.

The crash helmet shown in FIG. 4 is ventilated by a single front air inlet 5 which opens into a duct 6 as described above, which directs and distributes the air over said surface of material layer 3, which distributes the air over the whole skull circumference from the skull top portion.

The FIG. 5 shows a crash helmet of the so-called "integral" type. In the embodiment shown, an air inlet 5 is provided into each one of the side surfaces of the helmet outer wall 1, adjacent the bottom thereof, and the ventilating air is fed inside the helmet adjacent the skull top, through ducts 6 that distribute the air as described above, over the surface 8 of material layer 3 which diffuses in turn the air over the whole skull circumference from the top thereof, the air discharge outside the helmet being made either through openings provided in the helmet back as described above, or at the helmet bottom, without air outlets being necessarily required in said helmet back.

The integral crash helmet shown in FIG. 6 is provided with a single air inlet 5 in the front portion of said helmet, the ventilating air being distributed inside said helmet by means of a duct 6 which is so arranged as to feed and distribute the air through openings 12' towards the skull top and over the sides thereof, the ventilating air discharge being made as for the helmet shown in FIG. 5, through openings provided in the helmet back or at the bottom thereof. The air inlet 5 is provided with closing means 13 which are comprised of a movable flap 14 which is rotatably mounted on helmet wall 1 and which faces the air inlet, said flap and the hinge thereof being so arranged as to be movable to adjust the air flow and possibly stop the ventilating, between two end positions, one position where the air inlet is completely open and another position where said inlet is closed-off.

FIG. 7 shows a separate duct 6 provided with said removable filter 11, which has a profile similar to the duct profile to let the shape thereof follow the duct shape, which allows retaining of the filter inside the duct without any intermediate element.

FIG. 8 shows on a larger scale than FIG. 5, the movable flap for adjusting the ventilating air flow through the helmet.

It must be understood that the invention is in no way limited to the above embodiments and that many changes may be brought therein without departing from the scope of the invention as defined by the appended claims.

I claim:

1. A crash helmet, particularly for drivers and passengers of motor vehicles such as motorcycles, motorbikes, and the like, said crash helmet having a solid outer wall for covering the head, said wall being lined inside with means for cushioning impacts, said helmet comprising at least one air inlet provided in that helmet area over which sweeps the air and so arranged as to canalize the air inside the helmet, means to distribute the air inside the helmet and at least one opening provided in the helmet wall in that area thereof over which the air does not sweep, to let the air escape from said helmet, said means for cushioning impacts comprising a first layer of compressible material including expanded polystyrene, which lines the helmet inner wall and a second material layer lining said first layer, which is an open-cell foam, said means for distributing the air inside the helmet comprising a duct provided in said first material layer from said air inlet to said second material layer, the air flowing out from said duct being distributed inside the helmet through the open cells of said second material layer.

2. A crash helmet as claimed in claim 1, in which means are arranged inside said air inlet to filter the air, said air filtering means comprising a body formed of open-cell foam material, said body having a profile that fits inside said duct and said body being inserted into said duct.

3. Crash helmet as defined in claim 1, in which said duct is provided with a narrowed portion forming a Venturi section.

* * * * *